United States Patent [19]

Kimura

[11] Patent Number: 4,964,290

[45] Date of Patent: Oct. 23, 1990

[54] SMALL-DIAMETER METALLIC CONDUIT BENDING MACHINE

[75] Inventor: Sadao Kimura, Numazu, Japan

[73] Assignee: Usui Kokusai Sangyo Kaisha Ltd., Shizuoka, Japan

[21] Appl. No.: 369,310

[22] Filed: Jun. 21, 1989

[30] Foreign Application Priority Data

Oct. 20, 1988 [JP] Japan ..... 63-264954

[51] Int. Cl.[5] ..... B21D 7/024

[52] U.S. Cl. ..... 72/217; 72/388; 72/321

[58] Field of Search ..... 72/306, 319–321, 72/381, 384, 387, 388, 216–219, 403, 446, 415

[56] References Cited

U.S. PATENT DOCUMENTS

| | | | |
|---|---|---|---|
| 72,669 | 12/1867 | Noland | 72/219 |
| 747,466 | 12/1903 | McClellan | 72/217 |
| 910,282 | 1/1909 | Gerlock | 72/216 |
| 3,788,122 | 1/1974 | Ritter et al. | 72/217 |
| 4,248,273 | 2/1981 | Marcello | 72/217 |
| 4,662,204 | 5/1987 | Saegusa | 72/306 |
| 4,718,265 | 1/1988 | Post | 72/217 |
| 4,735,075 | 4/1988 | Saegusa | 72/306 |
| 4,805,436 | 2/1989 | Saegusa | 72/306 |

FOREIGN PATENT DOCUMENTS

| | | | |
|---|---|---|---|
| 1176967 | 8/1964 | Fed. Rep. of Germany | 72/219 |
| 995979 | 2/1983 | U.S.S.R. | 72/217 |
| 259126 | 10/1926 | United Kingdom | 72/320 |
| 2166675 | 5/1986 | United Kingdom | 72/217 |

*Primary Examiner*—Daniel C. Crane

*Attorney, Agent, or Firm*—Anthony J. Casella; Gerald E. Hespos

[57] ABSTRACT

A small-diameter metallic conduit bending machine comprises a stationary frame with a guide surface, a bending member for pressing a metallic conduit against the stationary frame, and an actuator for moving the bending member via a lever. One end of the lever supporting the bending member is pivoted to the stationary frame at a position lying substantially on the axial center line of the metallic conduit within a central portion of a bend section where the metallic conduit is bent so as to lie along the guide surface of the stationary frame. Thus, the metallic conduit can be readily inserted between the guide surface and the bending member, and two successive bending works can be completed through one action.

15 Claims, 6 Drawing Sheets

PRIOR ART

SMALL-DIAMETER METALLIC CONDUIT BENDING MACHINE

BACKGROUND OF THE INVENTION

1. Field of the Invention

This invention relates to a machine for bending a small-diameter metallic conduit at several points and more particularly, to a small-diameter metallic conduit bending machine adapted to shape a metallic conduit whose individual bend sections differ in the bend direction three-dimensionally from one another, not lying on the same plane, such as the fuel pipeline or brake pipeline of a car.

2. Description of the Prior Art

A conventional bending machine of the foregoing type includes a required number of bending units disposed correspondingly to a plurality of bend portions, each bending unit being configured as shown in FIG. 9 so that with respect to each bending work, a receiving roll 11 is moved by a cylinder 12 to come into contact with a metallic conduit 13, and then a bending roll 14 is moved by another cylinder 15 to bend the metallic conduit 13. In this drawing, 16 and 17 are mounts, 18 and 19 are stays, and 20 is a base.

According to the foregoing conventional bending machine, however, since the bending work is carried out by moving the receiving roll 11 and the bending roll 14 by means of the respective cylinders 12 and 15, each bending work needs two actions, thus, the machining time is long. Further, since the bending work is completed when the piston rods of both cylinders 12 and 15 reach their extended state, upon supply of a pressurized fluid into the cylinder ( generally, an air cylinder ) at the time of bending, the bending moment imposed on the piston rod increases, and flexure resulting from the reaction caused at the time of bending appears in the stays 18 and 19 and the mounts 16 and 17 for supporting the cylinders 12 and 15; consequently, a minute discrepancy ( called "breathing" by those skilled in the art ) appears between the receiving roll 11 and the bending roll 14, thereby resulting in variations in products. To eliminate such discrepancy, it is necessary to make the stays 18 and 19 and the mounts 16 and 17 thick and rigid. If designed so, however, the machine becomes large-sized and heavy ( but, in spite of such provisions, some discrepancy could not be eliminated ). Further, since the machine as a whole is necessary to be designed and composed while giving consideration to the position, orientation, etc. of each of the cylinders 12 and 15, receiving roll 11 and bending roll 14, a long time is required for its manufacture, such as assembly and adjustment; accordingly, the machine in the prior art sometimes could not be put in service in time where the starting of mass production was set. Other problems of the prior art are that parts and moving portions are numerous, the manufacturing cost is very high, and the durability is poor.

SUMMARY OF THE INVENTION

Therefore, it is an object of the present invention to provide a bending machine which is small in size, light in weight, easy to manufacture, and low in cost, and is capable of preventing the occurrence of discrepancy ( breathing ) and completing one or two successive bending works through one action, thereby shortening the machining time.

To achieve the foregoing object, a small-diameter metallic conduit bending machine according to the present invention comprises a stationary frame formed by connecting bar stock or pipe stock together into a shape substantially conforming to the finished curved shape of a metallic conduit over the whole length and having in a bend section a guide surface defined by a surface which has a curvature smaller than the bend radius of the metallic conduit in its lengthwise direction and is substantially orthogonal to a bend plane in its widthwise direction, a bending member having a peripheral surface facing the guide surface and attached to a lever extending outward whose one end is pivoted to a position lying substantially on the axial center line of the metallic conduit within a central portion of the bend section where the metallic conduit is bent so as to lie along the guide surface of the frame, and an actuator attached to the frame for turning the lever. With this configuration, the metallic conduit can be bent so as to lie along the guide surface.

In another feature, it comprises a stationary frame formed by connecting bar stock or pipe stock together into a shape substantially conforming to the finished curved shape of a metallic conduit over the whole length and having a guide surface defined by a surface which is substantially parallel to a bend plane in a bend section, a guide member secured on the stationary frame substantially orthogonally to the guide surface and having a curvature smaller than the bend radius of the metallic conduit, a bending member attached to a lever extending outward whose one end is pivoted to a position lying substantially on the axial center line of the metallic conduit within a central portion of the bend section where the metallic conduit is bent so as to lie along the guide surface and the guide member, and an actuator attached to the frame for turning the lever.

Additionally, the frame includes two successive bend sections oriented oppositely but lying substantially on the same bend plane, the length of the lever is identical with the distance from the center of rotation thereof to the center of second bending, the curvature of the peripheral surface of the bending member is equal to the curvature of the second bend section, the stationary frame formed by connecting bar stock or pipe stock together by welding is shaped substantially quadrangular in cross section, the guide member is made of a plate piece or block, and the bending member is made of a roll which is driven by the actuator.

As summarized above, the present invention carries out the bending work by means of the stationary frame with the guide surface, and the bending member moved inward by the actuator, such as air cylinder or rotary actuator, attached directly or via a bracket to the frame such that the metallic conduit is bent so as to lie along the guide surface or along the guide surface and the guide member. Therefore, since the actuator for actuating the bending member is connected directly or via the bracket to the stationary frame, flexure is prevented from appearing because no stay nor the like is used. Since the bending work is completed when the piston rod of the air cylinder is in the pulling state in contrast to the prior art wherein it is completed when the piston rod is in the pushing state ( in the extended state ), no appreciable bending moment is imposed on the piston rod or the like at the completion of each bending work, and the influence of looseness of a bush provided for the piston rod is reduced minimum; thus, the generation of even a minute discrepancy ( breathing ) with the bending member is prevented. In this regard, to make it easy to bring the metallic conduit before bending onto the guide surface or between the guide member and the bending member, the spacing between them must be made adequately wide. According to the present invention, the rotating/supporting shaft of the lever with the bending member attached thereto is pivoted to the frame at a position lying substantially on the axial center line of the metallic conduit within the central portion of the bend section; thus, the foregoing spacing opens wide. Since the contacting portion between the bending member and the metallic conduit does not shift appreciably up to the completion of the bending work, no scratch results on the surface of the metallic conduit and a surface treatment coating never peels off in the bending work. Even where the bending work is carried out while bringing the bending member into contact with a nut, spool, flare, etc. provided or formed in an end portion of the metallic conduit, the machining accuracy is enhanced without causing collapsing of the screw thread and deformation of the spool, flare, and the like. Since the circle traced by the bending member is smaller than where the bending member moves with taking the center of bending as the axis of rotation, the interval or distance between adjacent bending works can be narrowed, a subsequent bending work can be performed readily even when the preceding bending position is not spaced enough therefrom, and two steps of bending can be completed through one action if desired. Therefore, the machining time can be shortened, and the machine can be made small in size and light in weight because the bending member ( inclusive of the actuator ) is disposed so as to face the frame.

DETAILED DESCRIPTION OF THE PREFERRED EMBODIMENTS

Figure 1:
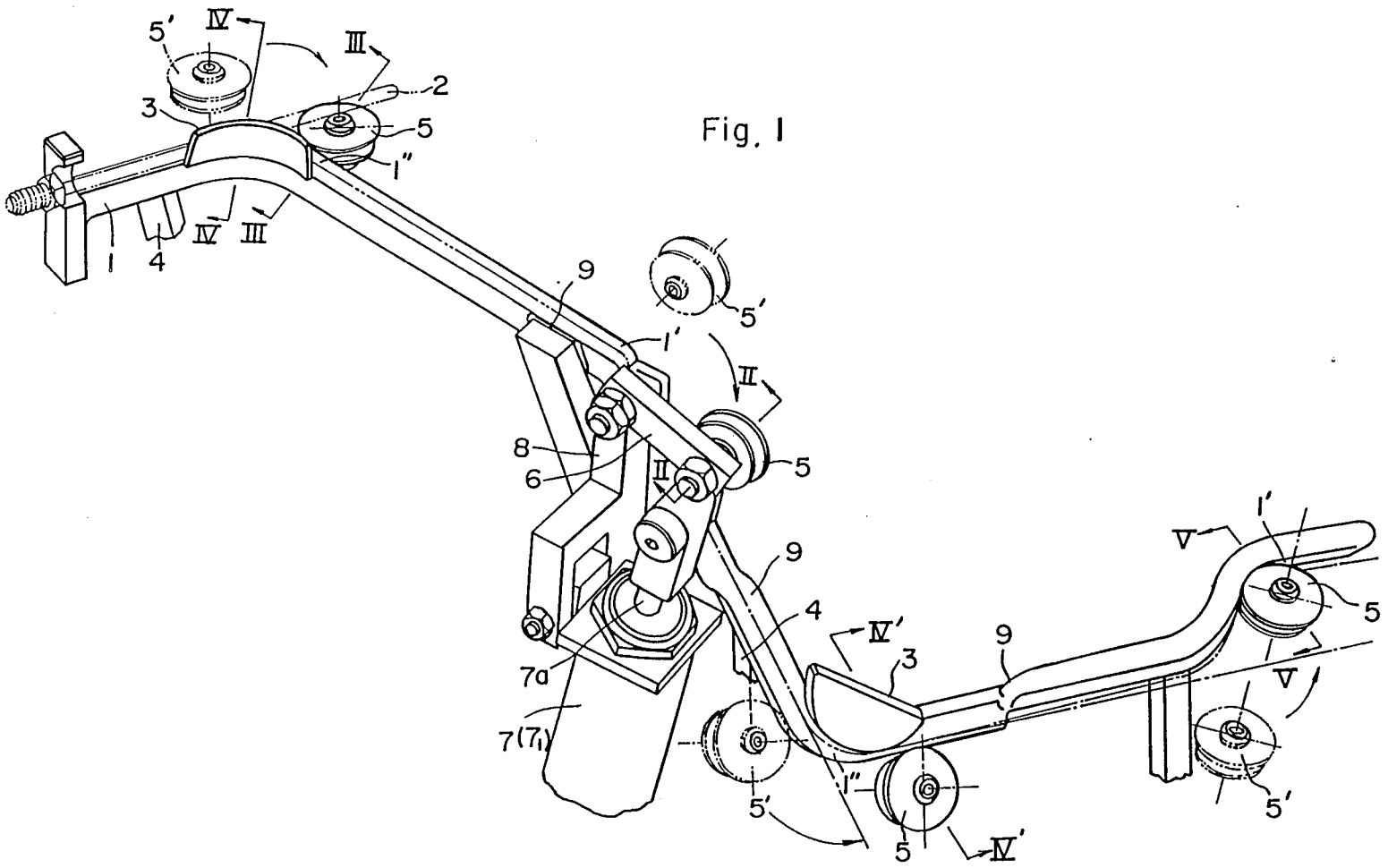
FIG. 1 is a fragmentary perspective view showing an embodiment of the present invention.
Figure 2:
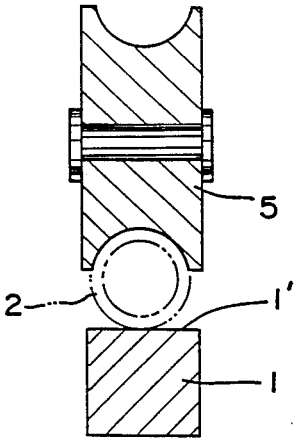
FIG. 2 is an enlarged sectional view taken in the direction of the arrows along line II—II of FIG. 1.
Figure 3:
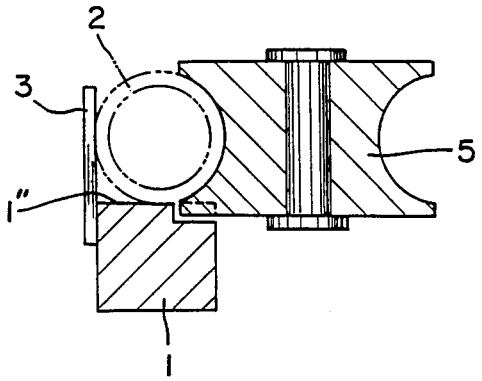
FIG. 3 is an enlarged sectional view taken in the direction of the arrows along line III—III of FIG. 1.
Figure 4B:
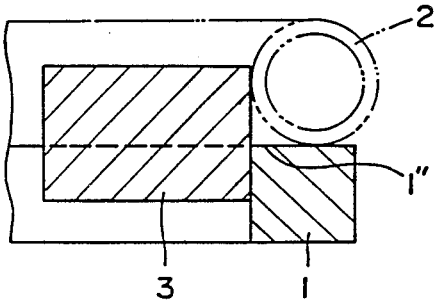
FIGS. 4(*a*) and (*b*) are enlarged sectional views taken in the direction of the arrows along line IV—IV and along line IV'—IV', respectively, of FIG. 1.
Figure 4A:
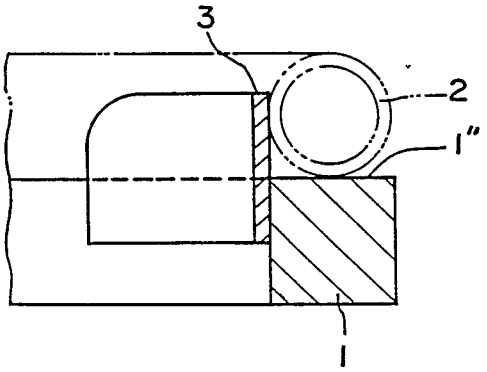
Figure 5:
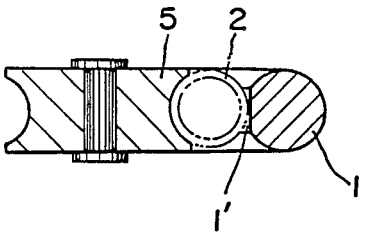
FIG. 5 is an enlarged sectional view taken in the direction of the arrows along line V—V of FIG. 1.
Figure 6:
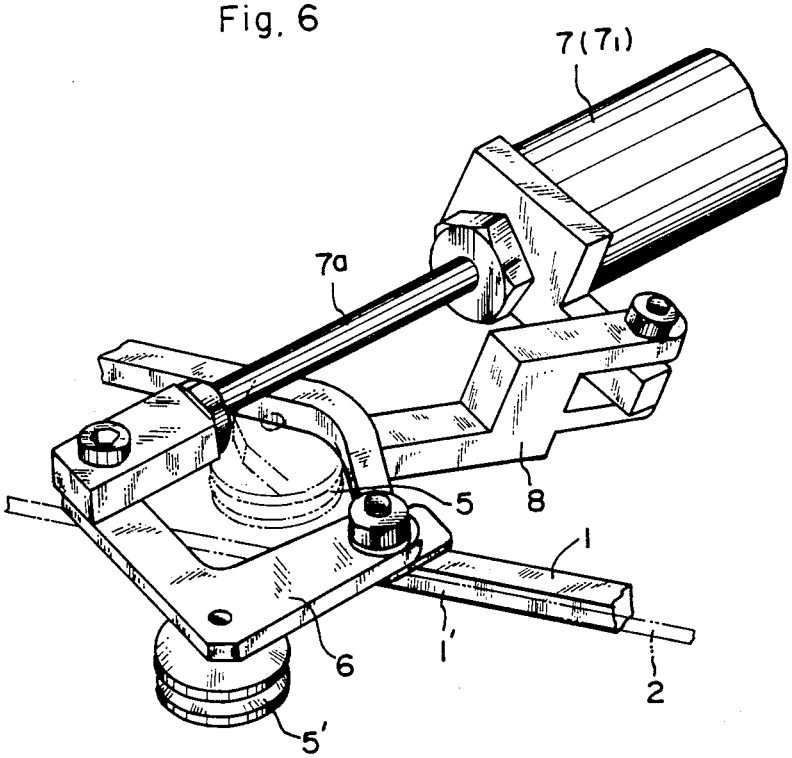
FIG. 6 is a perspective view showing another embodiment.

In FIGS. 1 through 8, 1 is an elongate stationary frame made of bar stock ( see FIGS. 2 through 5 ), pipe stock, or the like connected by welding 9 in continuous form, which substantially conforms in curved shape to a metallic conduit 2 over the whole length and has a first guide surface 1' defined by a surface whose widthwise direction is substantially orthogonal to a bend plane and a second guide surface 1'' defined by a surface substantially parallel to the bend plane in the vicinity of a bend section, preferably within the range of bend angle, the sectional contour of the frame including a flat portion and preferably being shaped substantially quadrangular in cross section. However, the sectional shape of the second guide surface 1'' is not necessarily limited to the above, but may take a circular shape; in this latter case, the second guide surface 1'' means a surface which extends substantially orthogonally to a guide member 3 hereinafter described and is formed by lines tangential to the outer peripheral surface of the metallic conduit 2. At a given position in relation to the frame 1 where the bending of the metallic conduit 2 is performed, there is provided a guide member 3 which is secured by welding or the like in a direction substantially orthogonal to both the first guide surface 1' and the second guide surface 1''. The curvature or shape of each of the first guide surface 1', second guide surface 1'', guide member 3, frame 1, etc. is made smaller than the bend radius of the metallic conduit 2 in consideration of the spring back of the metallic conduit 2 that occurs upon bending. Here, the guide member 3 may be made of a plate piece as shown in FIG. 4(*a*) or of a block as shown in FIG. 4(*b*). Although the frame 1 can be secured on a base ( not shown ) by means of a necessary number of posts 4, according to the present invention, the base is not necessarily needed if the posts 4 are connected together, in contrast to the prior art. 5 is a bending member which is disposed movably toward the stationary frame 1 while pressing the metallic conduit 2 against so as to lie along the first guide surface 1' or along the second guide surface 1'' and the guide member 3. Specifically, the bending member for effecting the bending work in cooperation with the first guide surface 1' is disposed so that its peripheral surface faces the first guide surface 1', whereas the bending member 5 for effecting the bending work in cooperation with the second guide surface 1'' and the guide member 3 is disposed so that its moving direction is substantially parallel to the second guide surface 1'' or inclined slightly therefrom. Here, 5' designates the position of the bending member before the bending work. The bending member 5 is attached to a lever 6 ( which is represented by a rod-like lever in FIG. 1 and by an L-shaped lever in FIG. 6, both identical in function ), and this lever 6, whose center of rotation is pivoted to the frame 1 at a position lying substantially on the axial center line of the metallic conduit 2 within a central portion of the bend section where the metallic conduit 2 is bent, extends outward. The other end of the lever is rotatably supported by the distal end of a piston rod 7*a* forming an actuator 7 ( the drawing shows an air cylinder $7_1$ ), and the one end of the air cylinder $7_1$ is pivoted to a bracket 8 attached to the frame 1, so that the lever can turn in the direction of the piston rod respondingly to the extension/retraction of the piston rod 7*a*. Although the bending member 5 may be actuated by a rotary actuator $7_2$ shown in FIG. 8, as well as the actuator 7 in the form of the air cylinder $7_1$ as illustrated, in either case, the rotating/supporting shaft of the lever 6 must be positioned so as to lie substantially on the axial center line of the metallic conduit within the central portion of the bend section of the metallic conduit 2 where it is bent so as to lie along the guide surface.

The bending work of the metallic conduit 2 will now be described. At first, one end of the metallic conduit 2 is locked and secured to a lock member mounted at one end of the frame 1 by the use of an end fixture ( see FIG. 1 ) in a first mode, or a given point in an intermediate portion of the metallic conduit 2 which is indexed using a stopper or the like is secured to an intermediate portion of the frame 1 by the use of a clamp tool or the like in a second mode. Then, the bending work is carried out from the secured end toward the free end in the first mode, or from the secured portion toward both free ends in the second mode, by causing the circular movement of the bending member 5 progressively toward the frame 1 so that the metallic conduit 2 is pressed against so as to lie along the first guide surface 1' or along the second guide surface 1'' and the guide member 3 of the frame 1 in contact therewith.

Figure 7:
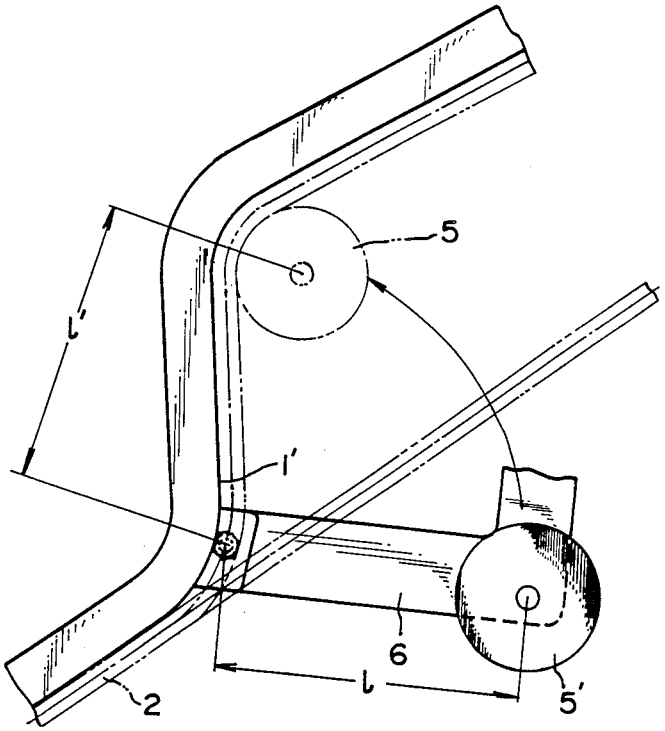
FIG. 7 is a schematic bottom view corresponding to FIG. 6.
Figure 8:
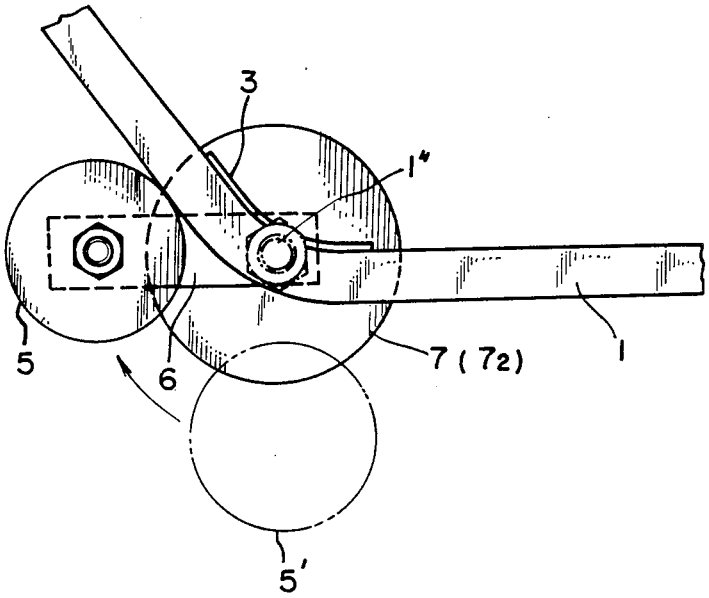
FIG. 8 is a front view showing still another embodiment.
Figure 9:
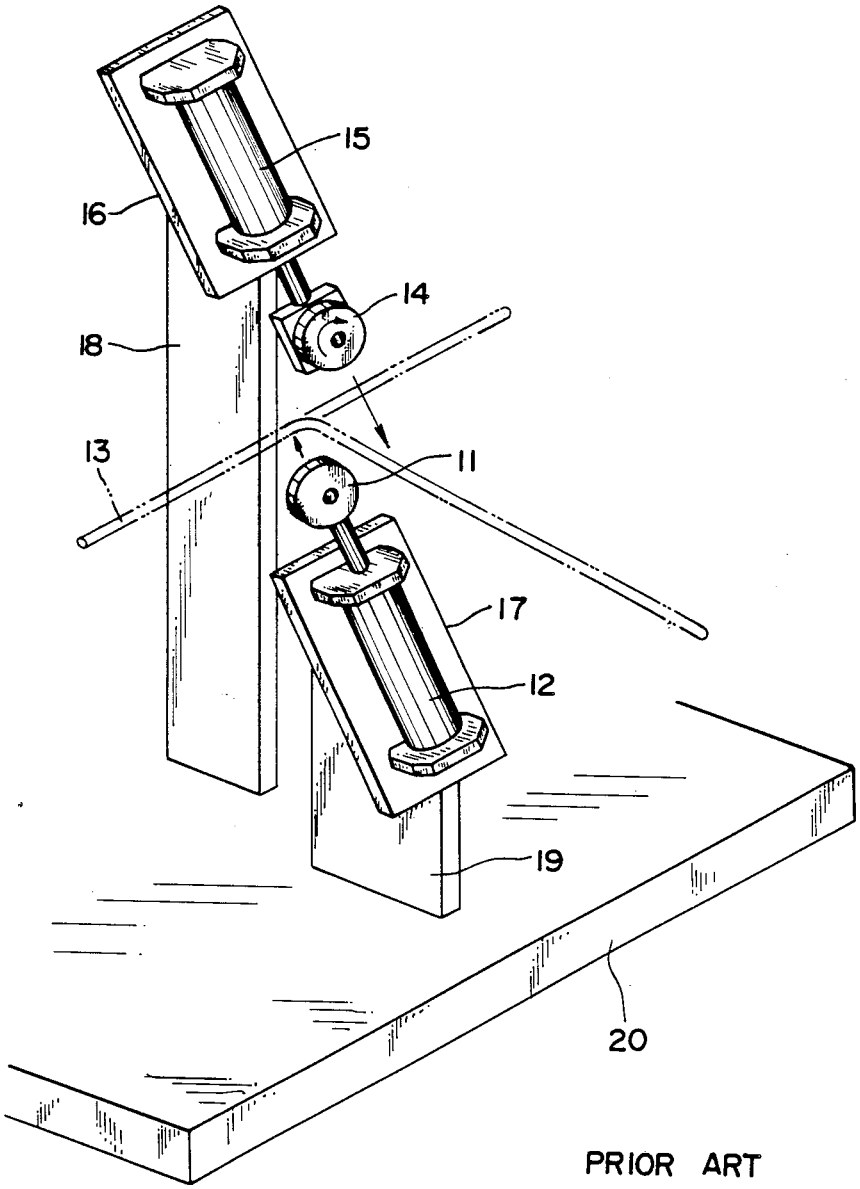
FIG. 9 is a perspective view showing a conventional bending machine.

In the foregoing work, it is necessary to leave a wide spacing between the bending member 5 and the guide surface 1' or the guide member 3 before the bending work of the metallic conduit 2 for easy insertion thereof. According to the present invention, the rotating/supporting shaft of the lever 6 with the bending member 5 attached thereto is pivoted to the frame 1 at a position lying substantially on the axial center line of the metallic conduit 2 within the central portion of the bend section; consequently, the foregoing spacing can be left open as wide as the length of the lever, and the circle traced by the bending member is small compared with the case where the rotating/supporting shaft is located just at the center of the bend radius; therefore, the metallic conduit is easily taken out, and a subsequent bending work can be performed even if the preceding bending work has been performed at a position very close to that where this subsequent bending is to be carried out. On the other hand, where two successive bend sections oriented oppositely are defined closely and lie substantially on the same bend plane along the frame 1 as shown in FIG. 7, it is possible to complete two steps of bending through one action by making the length l of the lever 6 from its supporting shaft substantially identical with the distance l' from the center of rotation of the supporting shaft to the center of second bending in consideration of the spring back of the metallic conduit 2 and by making the curvature of the bending member 5 substantially equal to the curvature of the second bend section.

It should be noted that the machine of the present invention can be used in bending bar stock, as well as metallic conduits.

As described in greater detail, according to the present invention, the bending work is carried out by means of the stationary frame 1 and the bending member 5 which is moved inward via the lever 6 by the actuator 7 secured directly or via the bracket 8 to the frame 1 such that the metallic conduit 2 is bent so as to lie along the guide surface 1' or along the guide member 3 and the second guide surface 1''. Therefore, since the actuator for actuating the bending member 5 is connected directly or via the bracket 8 to the stationary frame 1, flexure is prevented from appearing because no stay nor the like is used. Since the bending member 5 is actuated as the piston rod is pulled by the actuator 7, the influence of looseness of a bush provided for the piston rod can be reduced minimum, in contrast to the prior art wherein the pushed or extended state is utilized for actuation, and no appreciable bending moment can be imposed. Accordingly, the generation of even a minute discrepancy ( breathing ) between the bending member 5 and the guide surface 1' and between the guide surface 1'' and the guide member 3 can be prevented, whereby curved products of high accuracy can be fabricated. Further, since each bending work is completed through one action, the machining time can be shortened. Especially, since the supporting shaft of the lever for moving the bending member is pivoted to the frame at a position lying substantially on the axial center line of the metallic conduit within the central portion of the bend section, the contacting portion between the bending member and the metallic conduit does not shift appreciably up to the completion of the bending work; therefore, no scratch results on the surface of the finished metallic conduit, and a surface treatment coating never peels off. Particularly, even where the bending work is carried out while bringing the bending member into contact with a nut, spool, flare, etc. provided or formed in an end portion of the metallic conduit, the machining accuracy can be enhanced without causing collapsing of the screw thread and deformation of the spool, flare, and the like. Further, since an adequate spacing can be left between the guide surface or guide member of the bend section and the bending member, it becomes easy to take out the metallic conduit. Since the circle traced by the bending member can be made small, the distance up to a subsequent bend section can be shortened, whereby in case two bend sections oriented oppositely are defined closely and lie substantially on the same bend plane, two steps of bending can be completed through one action. Further, since the whole bending machine can be composed only by disposing some bending members so as to operate toward the frame; compared with the prior art, the parts can be remarkably decreased, the machine can be made small in size and light in weight, the manufacturing cost can be remarkably reduced, and the time necessary for manufacture can be remarkably shortened; thus, the machine can be surely put in a serviceable state before the starting of mass production.

What is claimed is:

1. A small-diameter metallic conduit bending machine for bending a small-diameter metal conduit into a finished curved shape, said shape comprising at least first and second oppositely oriented curves lying in a single bend plane, said machine comprising:

a stationary frame formed by connecting bar stock or pipe stock together into a shape substantially conforming to the finished curved shape of the metallic conduit over the whole length and having an elongated guide surface, fixedly connected to the frame and against which said conduit is bendable, said guide surface defining a convex bend section which has a curvature smaller than the bend radius of the first curve of the metallic conduit in the lengthwise direction of the guide surface and which is substantially orthogonal to the bend plane of the conduit in the widthwise direction of the guide surface, the guide surface further defining a concave bend section having a curvature smaller than the bend radius of the second curve of the conduit in the lengthwise direction of the guide surface and being substantially orthogonal to the bend plane of the conduit in the widthwise direction of the guide surface.

a bending member having a convex peripheral surface substantially equal to the curvature of the concave bend section facing the guide surface and attached to a lever extending outward from the convex bend section, one end of said lever being pivoted to a position lying substantially on the axial center line of the metallic conduit within a central portion of the convex bend section the distance from the center of rotation of the lever to the center of curvature of the guide member being equal to the distance from the center of rotation of the lever to the center of curvature of the concave bend section, and an actuator attached to the frame for turning the lever, whereby the metallic conduit is bent so as to lie along the guide surface through the convex and concave bend sections thereof.

2. A small-diameter metallic conduit bending machine according to claim 1, wherein the bar stock or pipe stock is substantially quadrangular in cross section.

3. A small-diameter metallic conduit bending machine according to claim 1, wherein the bar stock or pipe stock is connected by welding.

4. A small-diameter metallic conduit bending machine according to claim 1, wherein the bending member is made of a roll which is driven by the actuator.

5. A small-diameter metallic conduit bending machine according to claim 1 wherein the actuator comprises a cylinder mounted to the frame and a piston mounted to the bending member, said piston being slidably moveable into and out of the cylinder, said cylinder and said piston being disposed such that the conduit is bent by withdrawing the piston into the cylinder.

6. A small-diameter metallic conduit bending machine according to claim 5 wherein the lever is generally L-shaped and comprises first and second intersecting legs, the bending member being disposed substantially at the intersection of said legs, a portion of one said leg remote from the intersection of said legs defining the portion of said lever being pivoted to a position on the axial center line of the metallic conduit, said piston being pivoted to a portion of the other leg of said lever at a location thereon remote from the intersection of said legs.

7. A small-diameter metallic conduit bending machine as in claim 6 further comprising an elongated bracket having one end pivoted to the cylinder and an opposed end pivoted to the frame for permitting the piston rod to change alignment during the bending of the conduit.

8. A small-diameter metallic conduit bending machine for bending a small-diameter metallic conduit into a finished curved shape, said shape comprising at least first and second oppositely oriented curves lying in a single plane, said machine comprising, a stationary frame formed by connecting bar stock or pipe stock together into a shape substantially conforming to the finished curved shape of the metallic conduit over the whole length and having an elongated guide surface comprising first and second bend sections lying in a single plane and substantially conforming to the first and second curves respectively of the metallic conduit, a guide member secured on the stationary frame substantially orthogonally to the guide surface and having a convex portion with a curvature smaller than the bend radius of the first curve of the metallic conduit and a concave portion with a curvature smaller than the bend radius of the second curve of the metallic conduit;

a bend member having a convex peripheral surface substantially equal to the curvature of the convave portion of the guide member, said bending member being attached to a lever extending outward, with one end of the lever being pivoted to a position lying substantially on the axial center line of the metallic conduit within a central portion of the bend section defined by the convex section of the guide member, the distance from the center of rotation of the lever to the center of curvature at the bend member being equal to the distance from the center of rotation of the lever to the center of curvature of the concave section of the guide member, and an actuator attached to the frame for turning the lever whereby the metallic conduit is bent so as to lie along the planar portion of the guide surface and against the respective convex and concave sections of the guide member.

9. A small-diameter metallic conduit bending machine according to claim 8, wherein the bar stock or pipe stock is substantially quadrangular in cross section.

10. A small-diameter metallic conduit bending machine according to claim 8, wherein the bar stock or pipe stock is connected by welding.

11. A small-diameter metallic conduit bending machine according to claim 8, wherein the guide member is made of a plate piece or block.

12. A small-diameter metallic conduit bending machine according to claim 8, wherein the bending member is made of a roll which is driven by the actuator.

13. A small-diameter metallic conduit bending machine according to claim 8 wherein the actuator comprises a cylinder mounted to the frame and a piston mounted to the bending member, said piston being slidably moveable into and out of the cylinder, said cylinder and said piston being disposed such that the conduit is bent by withdrawing the piston into the cylinder.

14. A small-diameter metallic conduit bending machine according to claim 13 wherein the lever is generally L-shaped and comprises first and second intersecting legs, the bending member being disposed substantially at the intersection of said legs, a portion of one said leg remote from the intersection of said legs defining the portion of said lever being pivoted to a position on the axial center line of the metallic conduit, said piston being pivoted to a portion of the other leg of said lever at a location thereon remote from the intersection of said legs.

15. A small-diameter metallic conduit bending machine as in claim 14 wherein further comprising an elongated bracket having one end pivoted to the cylinder and an opposed end pivoted to the frame at a location for permitting the piston rod to change alignment during the bending of the conduit.

* * * * *